United States Patent [19]

Bervig

[11] Patent Number: 4,767,938

[45] **Date of Patent: * Aug. 30, 1988**

[54] FLUID DYNAMIC ENERGY PRODUCING DEVICE

[76] Inventor: Dale R. Bervig, 10235 Oakmont Cir., Lenexa, Kans. 66215

[ * ] Notice: The portion of the term of this patent subsequent to Jul. 5, 2000 has been disclaimed.

[21] Appl. No.: 908,921

[22] Filed: Sep. 12, 1986

Related U.S. Application Data

[60] Continuation of Ser. No. 771,146, Aug. 29, 1985, abandoned, which is a continuation of Ser. No. 636,320, Jul. 31, 1984, abandoned, which is a continuation of Ser. No. 558,162, Dec. 5, 1983, abandoned, which is a continuation of Ser. No. 320,219, Nov. 12, 1981, abandoned, which is a division of Ser. No. 217,654, Dec. 18, 1980, Pat. No. 4,392,062.

[51] Int. Cl.[4] ..... F01K 25/04; F04F 1/18

[52] U.S. Cl. ..... 290/54; 290/1 R; 417/108; 417/150; 60/689; 60/721

[58] Field of Search ..... 290/1 R, 42, 43, 44, 290/52, 53, 54, 55; 417/108, 107, 109, 150; 60/689, 721, 398, 340

[56] References Cited

U.S. PATENT DOCUMENTS

| | | | |
|---|---|---|---|
| 825,364 | 7/1960 | Vogt | 417/150 |
| 3,028,816 | 4/1962 | Walker et al. | 417/108 |
| 3,028,817 | 4/1962 | Cunetta | 417/108 |
| 3,375,664 | 4/1968 | Wells | 290/1 R X |
| 3,601,979 | 8/1971 | Singer | 60/721 X |
| 4,041,710 | 8/1977 | Kraus | 60/689 X |
| 4,084,375 | 4/1978 | Horwath . | |
| 4,110,980 | 9/1978 | Foulke | 417/108 X |
| 4,135,364 | 1/1979 | Busick | 290/54 X |
| 4,157,014 | 6/1979 | Clark, Jr. . | |
| 4,170,114 | 10/1979 | Pruett . | |
| 4,180,980 | 1/1980 | Marks et al. | 417/108 X |
| 4,183,400 | 1/1980 | Seifert | 417/108 X |
| 4,316,680 | 2/1982 | Phipps et al. | 417/108 X |
| 4,355,513 | 10/1982 | Girden | 417/108 X |
| 4,392,062 | 7/1983 | Bervig | 290/54 |

*Primary Examiner*—William M. Shoop, Jr.
*Assistant Examiner*—Paul Ip
*Attorney, Agent, or Firm*—Litman, McMahon & Brown

[57] ABSTRACT

A fluid dynamic device is provided which includes a fluid holding and U-shaped conduit having a first leg and a second leg, an electrical generating device positioned between and in flow communication with the first and second legs and being motivated by passage of the fluid therethrough, and injection means for injecting a substance of substantially less density relative to the normal density of the fluid within the second leg and at a location spaced below the top end of the first leg. The second leg diverges substantially where the low density substance is injected thereinto so as to accommodate expansion of the fluid occasioned by injection of the low density substance thereinto. In one embodiment, the device utilizes a compressible gas, such as air, as the low density substance which is provided by gas compressors.

6 Claims, 3 Drawing Sheets

FLUID DYNAMIC ENERGY PRODUCING DEVICE

CROSS-REFERENCE TO RELATED APPLICATION

The present application is a continuation of Ser. No. 771,146 on a Fluid Dynamic Energy Producing Device, filed Aug. 29, 1985, now abandoned, which was a continuation of Ser. No. 636,320 on a fluid Dynamic Energy Producing Device, filed July 31, 1984, now abandoned, which was a continuation of Ser. No. 558,162 on a FLUID DYNAMIC ENERGY PRODUCING DEVICE, filed Dec. 5, 1983, now abandoned which was a continuation of Ser. No. 320,219 on a FLUID DYNAMIC ENERGY PRODUCING DEVICE, filed Nov. 12, 1981, now abandoned which was a division of Ser. No. 217,654 on a FLUID DYNAMIC ENERGY PRODUCING DEVICE, filed Dec. 18, 1980, now U.S. Pat. No. 4,392,062.

BACKGROUND OF THE INVENTION

The present invention relates to fluid dynamic energy storage and producing devices and, in particular, to such devices having a loop arrangement wherein a low density substance is injected into a fluid within one leg of the loop so as to create a dynamic circulation of the fluid therein which circulation of the fluid is passed through an electrical generating device so as to produce energy.

Electrical generation companies normally operate on a power grid system, wherein numerous individual power plants of the fossil fuel type, nuclear type, or the like are joined together over common transmitting lines. These grid systems typically experience substantial swings in power usage, depending on seasons, weather, and time of day. Such power grids usually have certain base power production plants which operate during low power demands. One or more of such base plants may be varied in power output to accommodate savings in power output required by the grid. Such variation in power output tends to be harmful to the plants. In addition, during peak demands, additional relatively low efficiency plants are placed on the line. Because of the need to satisfy peak load demand, sufficient power plants must be available to the grid system to meet such peak loads at a relatively high cost for building and operating each plant. On the other hand, relatively few plants are necessary for average power usage periods. Thus, substantial capital outlays may be expended for power plants which are utilized only during peak power consumption periods, thereby increasing the overall average cost of electricity to a use in the grid system. It is also noted that start-up and shut-down of power plants is typically harmful to equipment and reduces the operating hour-life expectancy of such equipment.

It has therefore been suggested that a method be developed wherein the number of power plants, which are required to produce the average amount of electricity used by the grid system, would be operated on a somewhat continuous basis without adding additional power plants for peak periods. This would be accomplished by somehow storing the electrical energy generated by the power plants during low usage periods and utilizing the stored energy during high usage periods. Various methods have been proposed for accomplishing such an energy storage and retrieval concept. For example, two reservoirs may be located at vertically spaced positions. A conduit is utilized to connect the two reservoirs and contains a hydroelectric generator. During peak periods, water is allowed to flow from the upper reservoir to the lower reservoir, past the generator, so as to produce electricity. During low usage periods, electricity from the grid system is utilized to operate pumps which transfer the water from the lower reservoir back to the upper reservoir. A problem inherent with the prior art systsm has been generally that they are relatively inefficient, such that substantially more energy must be input to the system than can be withdrawn therefrom.

The present invention is partially based upon the concept that injection of a low density substance into a higher density fluid in one leg of a loop so as to substantially modify the density of the fluid in that leg will create a circulation within the loop. If a hydroelectric type generator is placed within the loop, the energy of the circulating fluid can be withdrawn. The concept of injecting a gas into a liquid in the manner so far described has been shown in the prior art. However, the prior art has injected gas into the liquid to effect a transporting phenomena which requires a substantial amount of work and does not produce a very highly efficient system. In particular, the prior art devices have typically required heating or some other means to actually lift the fluid or to change the density of the fluid on one side of the loop. This is occasioned by the design of the prior art devices which have not provided expansion in the riser leg of the loop, wherein the gas is injected, so that the fluid is free to expand generally in proportion to the reduction in density thereof. Although applicant does not wish to be tied to a particular theory, it is believed that the expansion of the riser at the point of injection of the gas, such as is provided herein, maximizes the effects of gravity and buoyancy while requiring a minimum amount of work to inject the gas into the fluid. Applicant has also found that utilization of foaming or surface tension enhancing agents in conjunction with gaseous channeling reducing devices within the riser tends to increase the overall efficiency of the device.

The amount of work required to inject a gas into a fluid, as in the present invention, is generally proportional to the pressure sensed in the fluid at the point of injection of the gas which in turn is proportional to the density of the fluid above the point of injection and the velocity of the fluid flowing past the injection point. Thus, as the density of the fluid decreases, the pressure required to inject the gas also decreases and, therefore, the work per unit volume of gas injected also decreases. On the other hand, additional quantities of gas must be injected into the system to effect reduced densities in the fluid; this in turn requires additional work to compress the gas, although it is being compressed at a lower pressure. Calculations show, when all of the work input is calculated, that at relatively low densities (at or below 30 percent of the normal fluid density), the amount of work required to compress and inject the gas into the fluid becomes approximately equal to or less than the amount of work produced by the generator. The efficiency of the system is apparently substantially enhanced by the relatively increasing effects of the forces related to gravity and buoyancy as the density of the fluid decreases within the riser.

OBJECTS OF THE INVENTION

Therefore, the objects of the present invention are: to provide a fluid dynamic energy device wherein energy could be stored from an electrical grid system during periods of low consumption and returned to the grid system during periods of peak consumption at a relatively high efficiency; to provide such a device wherein the effects of gravity and buoyancy are utilized in conjunction with an electrical energy input so as to produce at least as much or more electrical energy output as electrical energy input; to provide such a device comprising a U-tube or loop having a downcomer leg and a riser leg, a fluid dynamic electrical generator positioned at a bottom end of the legs and communicating therewith, and an injection mechanism for injecting a low density substance into fluid in the riser leg; to provide such a device wherein an air compressor is utilized to compress air during low electrical consumption periods, which air is stored under pressure and later injected into the riser leg during periods of peak electrical consumption so as to create a circulation within the loop thereby operating the generator and producing electricity; to provide such a device wherein the riser leg is divergent a the point of injection of the low density substance thereinto such that the fluid is allowed to expand in approximate proportion to the reduction in density thereof; to provide such a device wherein foaming agents and gas channeling reduction devices are utilized to aid in reducing density of the fluid in the riser and therefore improve the efficiency of the device; to provide such a device wherein aerodynamic airfoils are utilized to inject compressed gas into the riser in such a manner as to minimize back pressure upon the gas being injected; to provide a method for storing electrical power which provides a relatively efficient output of energy as compared to energy input into the system; to provide such a method which utilizes the forces of gravity and buoyancy in conjunction with a highly reduced density in the riser leg so as to output more energy than has been stored within the device; to provide such a method wherein fluid in the riser is allowed to expand in a divergent section thereof while compressed gas is being injected thereinto, including having a foaming agent within the fluid so as to substantially reduce the density of the fluid within the riser leg as compared to the downcomer leg, thereby creating a circulation within the loop; to provide such a device which is highly efficient in use, relatively less expensive to operate as compared to conventional power generating plants and is particularly well adapted for the proposed usage thereof.

Other objects and advantages of this invention will become apparent from the following description taken in connection with the accompanying drawings wherein are set forth by way of illustration and example, certain embodiments of this invention.

SUMMARY OF THE INVENTION

A fluid dynamic energy storage and production apparatus or device is provided which is especially adapted for withdrawing energy from an electrical power grid system during periods of low consumption and returning energy in the form of electricity to the power grid system during periods of peak demand. The device of the present invention includes a U-tube or loop means having at least a vertical downcomer leg and a vertical riser leg which are joined together near the bottom thereof and have positioned in flow communication therewith a power generator such as a conventional hydroelectric turbine generator. Preferably, the upper end of the legs are also connected so as to form a closed circuit; however, It is not required that the circuit be closed, provided that there is a sufficient supply of fluid and same need not be recycled. The legs preferably are interconnected by a reservoir into which the riser leg discharges, and from which the downcomer leg draws. Preferably, the reservoir will have a foam dispersing or breaking mechanism such as screen or the like to aid in degasification of fluid circulating through the loop. Also preferably, the reservoir has a top.

The fluid circulating through the loop may be essentially any fluid, and it is even conceivable that gas, especially relatively dense gases, could function as a circulating fluid. One requirement is that the fluid easily separate from a low density substance, which will be described later, in the reservoir before the fluid is recycled to the downcomer leg. However, it is preferable that the fluid be water due to the ready availability and relative low cost thereof. The relatively low density substance, preferably a gaseous fluid, is injected into the riser leg substantially below the inlet of the downcomer leg, which may be the top of the fluid reservoir, so as to modify the density of the fluid in the riser leg. It is preferable that the low density substance be a gas having a density substantially lower than the fluid. A suitable gas is ambient air because same is relatively abundant and inexpensive. However, it is foreseen that numerous other gases could be utilized, for instance helium or hydrogen. If non-air gases are used, it is normally preferable to have the reservoir entirely enclosed such that the gases may be recovered therefrom. When air is used as the gas, an outlet port from the reservoir may be utilized to exhaust the air which collects therein. It is perceivable that in some installations that a demisting unit may be useful in reducing the amount of makeup water necessary to operate the system. An electrical generating turbine, which would be operated from the airflow passing out of the reservoir enclosure, may also be utilized to produce electricity.

The power generated by the electrical generator in the loop is generally proportional to the density differential between the columns of fluid in the downcomer and riser legs and the size of the piping feeding fluid to the generator. It is therefore advantageous to reduce the density of the fluid in the riser leg as much as possible. When gas is utilized as the low density substance, this produces a second added advantage in that the pressure at the point of injection of the ga into the riser leg will be less in proportion to the reduction in density of the fluid in the riser leg, thereby requiring less work to pressurize the gas which is injected into the riser leg. It has been found that a foaming agent, often referred to as surface active agents or surface tension increasing agents, is beneficial to the reduction in density of the fluid when the gas is injected into the fluid with the foaming agent therein. Numerous foaming agents exist such as alkyl aryl sulfates and sulfonates, alkyl aryl amine salts, various alcohols, polyethers, and glycols, especially glycerine. Several foaming agents which have been found to be suitable are the following: T-DET which is the trademark of a non-ionic surfactant sold by Thompson, Hayward and OAKITE which is the trademark of a surfactant sold by Oakite products, Inc.

The downcomer leg provides fluid flow to the inlet of the electrical generator. The downcomer leg may converge somewhat near the entrance of the generator so as to reduce overall friction along the upper part of the downcomer leg. The riser leg is normally approximately the same diameter at the outlet of the generator as is the downcomer leg at the inlet thereof. However, the riser leg substantially diverges at the point of injection of the gas, when used, thereinto. Preferably, the divergence of the riser leg is substantially that required to allow the density of the fluid to decrease without causing additional work on the fluid by forcing some of the fluid to rise against the weight of the fluid thereabove without the effects of buoyancy on the fluid in the riser leg and gravity on the fluid in the downcomer leg. It is also desirable that too much volume is not added to the interior of the riser leg at this point such that the fluid tends to collapse, although it is foreseen that some range could be utilized so that power generators could be varied by injecting more or less gas and thereby changing the density of the fluid in the riser leg. It is noted that the divergence of the riser leg should continue throughout the length thereof, as the gas will typically tend to continue to expand as same nears the surface level of the fluid and there is less pressure thereabove.

The low density substance, often a gas, is injected into the fluid by injection means or mechanism which may be a variety of devices, including a multiplicity of small apertures passing through the wall of the riser leg, various nozzles such as sintered metal nozzles, a porous septum, or a perforated-pipe sparger, or by several different types of injection means used in combination. It is normally important that the dispersion of injected gas be as complete as possible, as fine bubbles tend to function better in reducing the density of the fluid than large bubbles. In particular, the large bubbles tend to agglomerate and form channels to the surface of the fluid so as to reduce the density thereof only in the small channels. Channeling is preferably avoided. Where necessary, it is desirable to include additional gaseous channel reducing devices or redistribution means throughout the riser leg such as screens or deflector baffles to break up large agglomerations of bubbles and further disperse same. In order to maintian an adequate dispersion of gas within the riser, it may be helpful in certain installations to inject gas into the riser leg at various vertical locations therealong. Preferably, the injection means minimizes back pressure upon the gas being injected into the riser leg, so as to reduce the pressure required of the gas and, thus, to reduce the work required to pressurize same. A particuarly advantageous injector means comprises airfoils or fins positioned such that the axis thereof is aligned with the flow of fluid through the riser leg. Current calculations show that a suitable point of dispersion from the airfoil is at the widest portion thereof due to the Bernoulli effect. It is foreseen that the dispersion apertures could be placed along such an airfoil at various locations.

The low density substance could come from numerous sources, for instance, the gaseous product of burning coal, a "puffed" solid such as plastics or the like; however, preferably the substance is compressed air which is produced by suitable compressors and pumped through conduits to the injection means. In many installations it will be necessary to store at least a portion of the compressed gas or air. This can be accomplished by air storage cylinders or preferably by forming an underground cavern into which the air is injected under pressure until needed by the device. Suitable caverns may be produced in hard rock, salt domes or beds, and porous media or the like where cavern walls have questionable integrity for holding pressurized air, the walls may be covered with plastic such a polypropylene. It is foreseen that in instances where the gas is not air, that it may be desirable to remove the gas from the reservoir as it collects therein and compress same before returning the compressed gas to storage or directly to the riser leg.

A method is provided for storage ard production of electrical energy in conjunction with the above described device including the steps of: filling a loop having a downcomer leg and a riser leg with a fluid which is in flow communication with a power generator; injecting a relatively low density substance relative to the fluid into the fluid in the riser leg substantially below the inlet of the downcomer leg; adding a foaming agent to the fluid; allowing the fluid to expand by divergence of the riser leg at the point of injection of the low density substance thereinto; allowing the fluid due to the forces of gravity and buoyancy, because of the reduced density of the fluid in the riser leg, to circulate through the loop and motivate the generator.

It is foreseen that the present invention could be utilized without a generator as a fluid pump.

The drawings constitute a part of this specification and include exemplary embodiments of the present invention and illustrate various objects and features thereof.

DETAILED DESCRIPTION OF THE PREFERRED EMBODIMENT

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
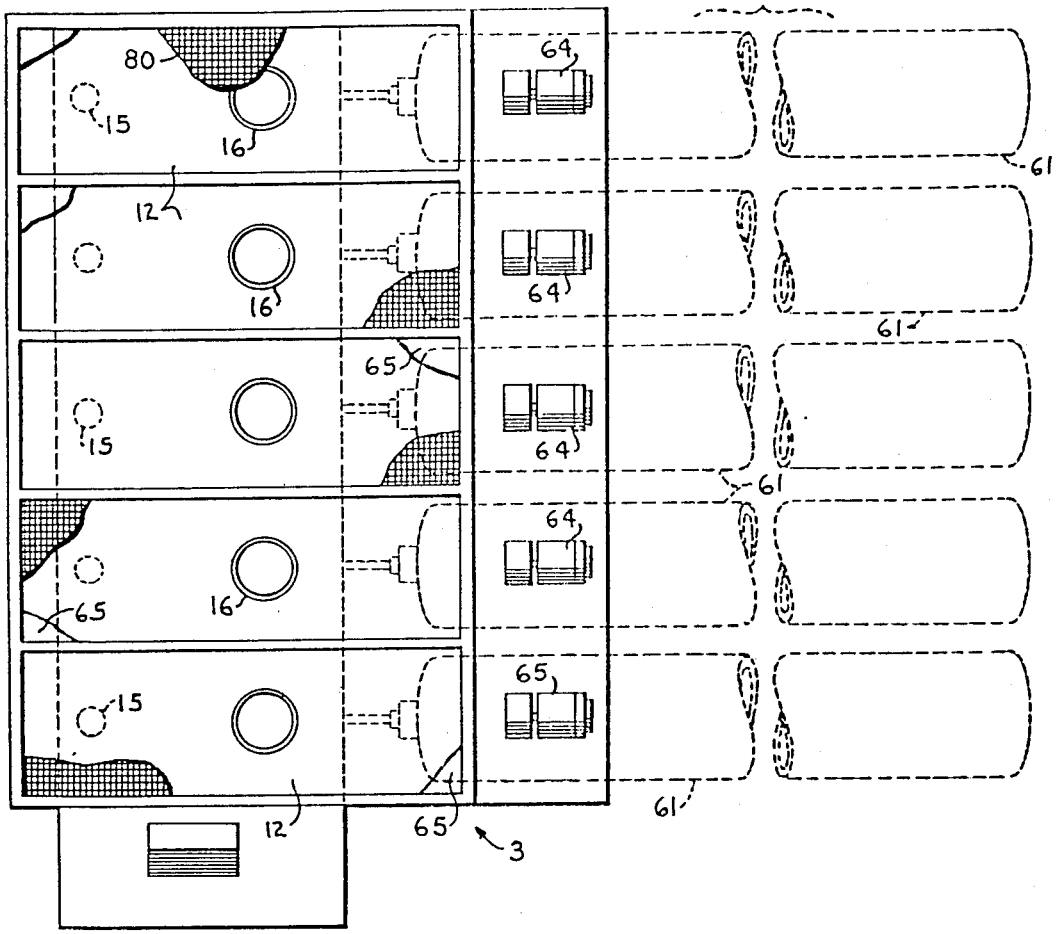
FIG. 1 is a partially schematic top plan view of an installation having a plurality of fluid dynamic energy storage and producing devices according to the present invention.

The reference numeral 1 generally refers to a fluid dynamic energy storage and production device. As shown in FIG. 1, a plurality of the devices 1 may be combined together to form an energy storage and production system 3. The production system 3 may include devices 1 which utilize some parts in common or alternatively each device 1 is a self-contained unit.

The device 1 may be all or partially, as shown in the illustrated example, located beneath ground level 5. This underground locating of the devices 1 can be advantageously utilized to present a relatively clean exterior and could also be used within the confines of the city in a completely undergound location. The design of the device 1 is also adaptable to being placed in almost any terrain or location with consequent advantages.

The illustrated device, shown in FIGS. 1 through 5, includes a conduit, U-tube, or loop 10 adapted to receive and hold a fluid 12 therein. The loop comprises an elongate and substantially vertically aligned downcomer leg 15 and an elongate riser leg 16 interconnected near the bottoms thereof by suitable piping 18 which conducts flow of fluid 12 from downcomer leg 15 to riser leg 16 through an electrical generator 19 comprising a hydroelectric-type turbine 20 in combination with a generation unit 21 for producing electricity. An upper reservoir 22 allows flow of the fluid 12 from the top or outlet of the riser leg 23 to the top or inlet 24 of the downcomer leg 15. An upper portion 27 of the downcomer leg has an interior diameter which is constricted at a location 28 intermediate therealong and channels flow of the fluid 12 from the reservoir 22 into a lower constricted conduit 30. The fluid 12 is directed into the generator 19 from the conduit 30. Flow exiting the generator 19 enters a lower portion 31 of the riser leg 16 which has a diameter substantially equal to the diameter of the downcomer leg lower portion 30.

Figure 7:
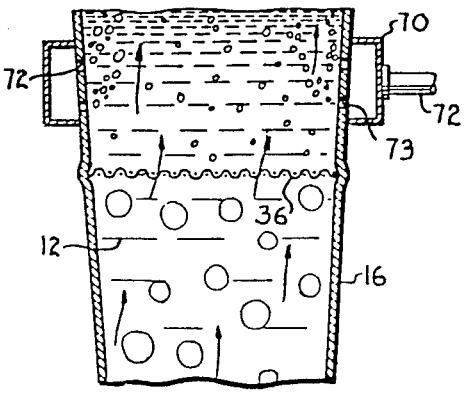
FIG. 7 is an enlarged and fragmentary front elevational view of a second modified device showing a portion of a riser leg similar to that shown in FIG. 2 with portions broken away to show detail thereof.
Figure 2:
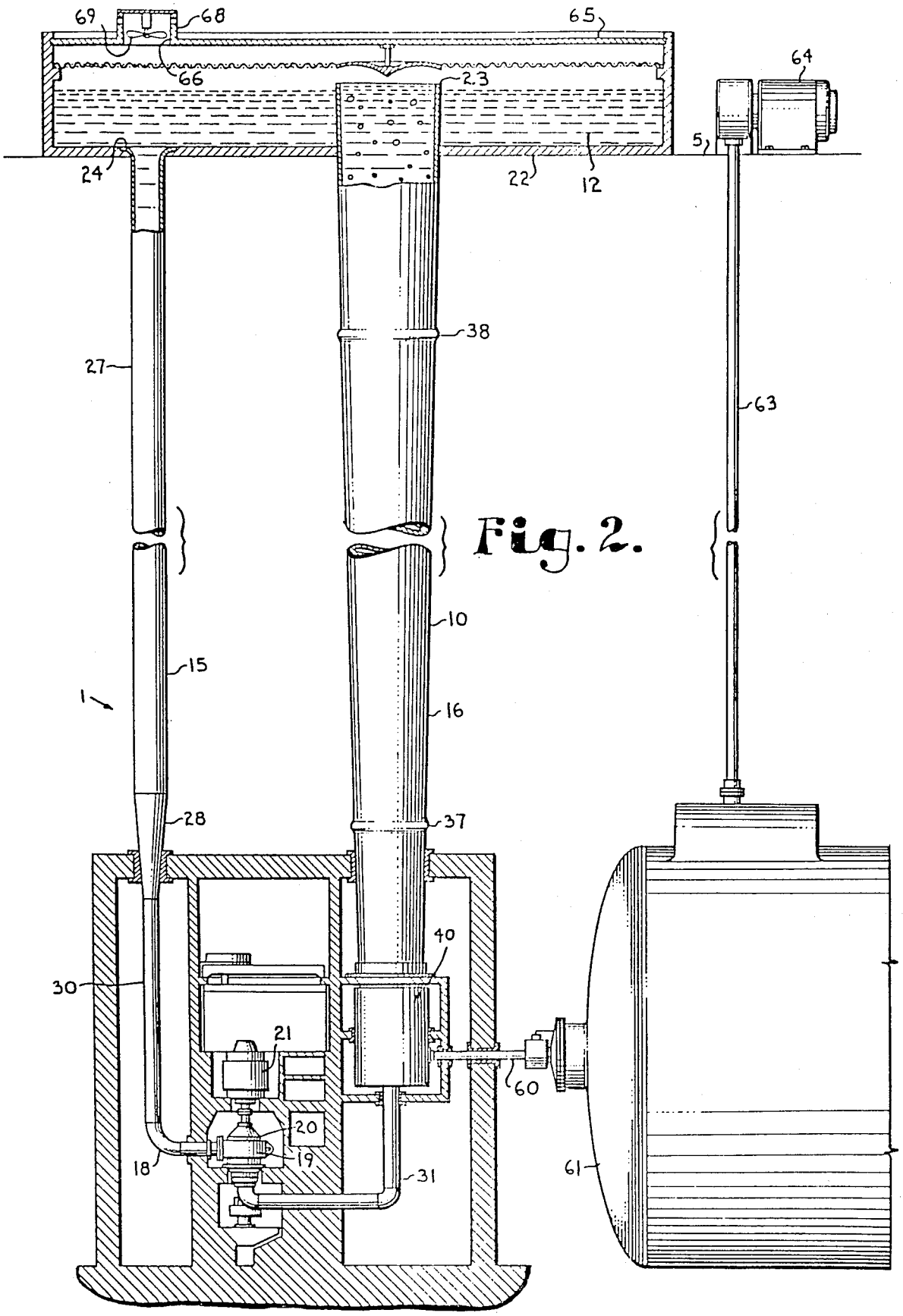
FIG. 2 is an enlarged and fragmentary side elevational view of one of the devices with portions broken away to show detail thereof and including a loop with a downcomer leg and a riser leg.
Figure 3:
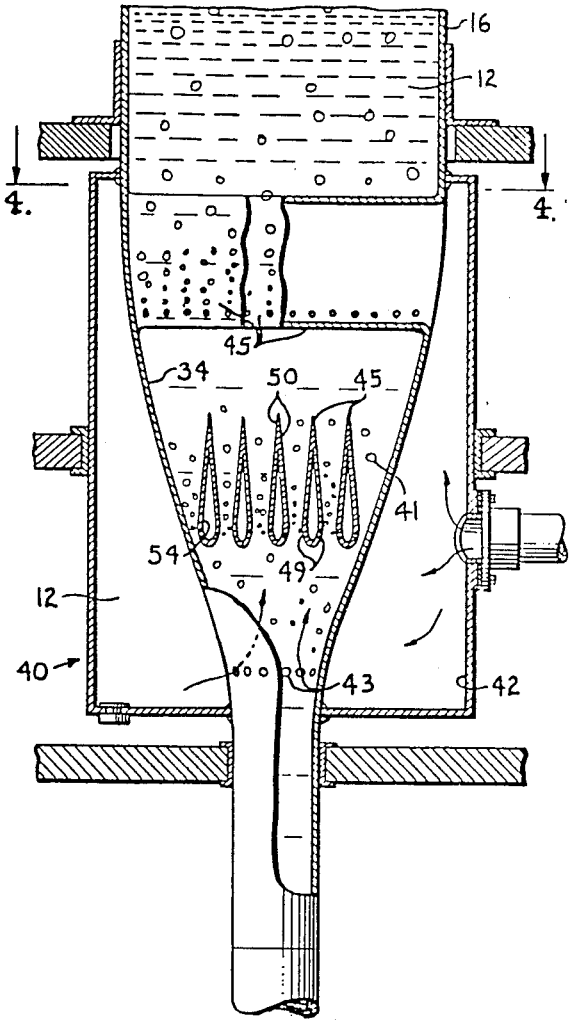
FIG. 3 is a further enlarged and fragmentary view of the device showing a portion of the riser leg with portions broken away to show detail thereof.

As seen in FIG. 3, the riser leg lower portion 31 opens into an expansion chamber 34 wherein the riser leg 16 substantially diverges as compared to the lower portion 31 thereof. The expansion chamber 34 is dimensioned to provide a suitable cross-sectional change in the riser leg 16 such that the fluid 12 is free to expand to a desired density. The riser leg 16 continues to diverge slightly between the expansion chamber 34 and the top thereof 23. As shown in FIG. 7, a dispersing grid, screen, or the like 36 is positioned at intermediate levels along the riser leg 16, such as at levels 37 and 38 in FIG. 2. The screen 36 tends to break down large bubbles within the fluid 12 and redistribute them as a fine dispersion, as shown in FIG. 7.

Figure 4:
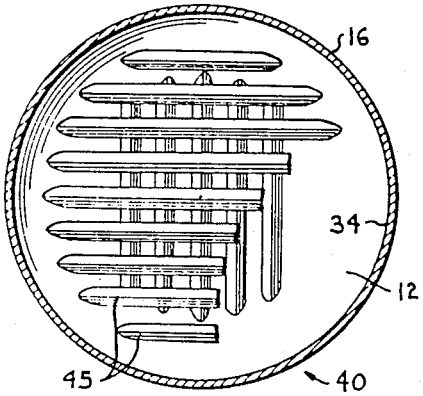
FIG. 4 is an enlarged cross-sectional view of the riser leg taken along line 4—4 of FIG. 3, showing gaseous injection members.
Figure 5:
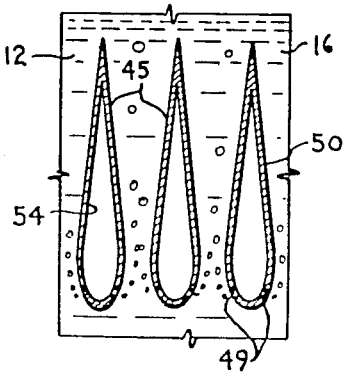
FIG. 5 is a further enlarged and fragmentary side elevational view of the gaseous injector members.

A low density substance injection mechanism 40 is located in conjunction with the expansion chamber 34 and is positioned substantially below the inlet 24 of the downcomer leg 15. As illustrated, the injection mechanism 40 is particularly adapted for injecting compressed air, as illustrated by bubble streams 41, into the fluid 12 which is preferably water. The injection mechanism shown comprises a pressure chamber 42 surrounding the riser leg expansion chamber 34 and communicating therewith through a plurality of apertures or pore 43 surrounding the riser leg and circumferentially spaced thereabout and through a series of airfoils 45 which have ends opening into the pressure chamber 42. The airfoils 45 are arranged in multiple vertically spaced rows which are aligned perpendicular to one another, as seen in FIG. 4. Each airfoil 45 also has an axis which is aligned with the flow of the fluid through the riser leg 16 and has a plurality of apertures 49 located along each side 50 thereof which communicate with the interior 54 of the respective airfoil so as to communicate pressurized air from the pressurization chamber 42 through the airfoils 45 and into the fluid 12 within the expansion chamber 34. Preferably, the pressurized air is injected in pulses which have a fairly high frequency of occurrence and which can be controlled by well known valving mechanisms. The high frequency pulses tend to produce a more uniform and smaller air bubble within the fluid 12.

Gas, preferably air, under pressure is conducted to the pressurization chamber 42 by a conduit 60 which in turn flow communicates with a pressurized air storage vessel 61. Air from a gas or air compressor 64 is provided to the pressurized air chamber 61 through conduit 63 which flow communicates with the air compressor 64. The air compressor 64 may be powered from electricity taken from an electrical power grid (not shown) or alternatively at least partially from the generator 19. Compressed air may be injected into the fluid 12 at various locations along the riser leg 16 at spaced apart locations from the expansion chamber 34, such as is illustrated in FIG. 7, by a compressed air collar 70 which communicates with the compressed air storage tank 61 through conduit 72 (which connects with chamber 61 by conduit not shown) and with the interior of the riser leg through apertures 73. It is foreseen that multiple air storage chambers could be utilized so as to provide compressed air at different pressures. In particular, air from a relatively highly pressurized chamber could be utilized on startup of the system to initiate entry of the air into the riser leg 16 when same is full of fluid of a normal density without air therein. After startup, the system could switch to lower pressurized air such that less work would be required in compressing the air before entry into the riser leg 16. It is also noted that compressed air having different pressurizations could be inserted into the riser leg 16 at various intermediate points therealong.

The reservoir 22 may be a suitable pond, chamber, or the like adapted for retaining the fluid 12. Preferably, the riser leg 16 will extend upwardly through the reservoir 22 or above the high level mark of the reservoir 22, so that the pressure of fluid having substantially a normal density will not tend to pressurize the fluid with reduced density within the riser leg 16. Upon overflowing the riser leg 16, the gas dispersed within the fluid 12 vaporizes or effervesces into an upper portion of the reservoir 22 and is illustrated as being exhausted into the ambient air surrounding the reservoir 22. Defoaming means for reducing bubbles or foam on the top of the fluid level in the reservoir 22 are preferably provided. Such foam reducing means may comprise a mesh of small wires with the ends exposed or, as illustrated, a screen 80. It is also forseen that spraying a light mist of the fluid over collected foam will substantially reduce the foam in the reservoir 22.

In operation, a foaming agent or surface-active agent such as glycerine or the like, is added to the fluid 12. The air compressor 64 is utilized to compress air, especially during lo electrical consumption periods, and store same within the high pressure chamber 61. When energy is desired, suitable valving means between the chamber 61 and the riser leg 16 are opened such that the compressed air bubbles through apertures 43 and airfoils 45 into the fluid in the expansion chamber 34. The compressed air reduces the density of the fluid in the riser leg 16 such that there is a tendancy for flow to initiate downwardly in the downcomer leg 15. The flow passes through the generator 19, producing electricity and up into the riser leg 16 wherein same is injected with additional compressed air so as to reduce the density thereof. The low density fluid in the riser leg 16 overflows the top 23 thereof into the reservoir 22, allowing the compressed air therein the escape. The fluid in the reservoir with compressed air escaped therefrom and having a substantially normal density for the fluid again is received within the downcomer leg 15 so as to complete a cycle.

The illustrated reservoir 22 is covered with top 65 and includes an exhaust port 66. In localities where acquisition of water is a problem, it may be necessary to have a demisting unit 68 to urge water in the air which is escaping from the chamber 22 to return back to the same. It is also foreseen that an air driven turbine 69 may be utilized to withdraw additional energy from the air escaping from the reservoir 22. Finally, it is also envisioned that where the fluid is not water and/or the density reducing substance is not air, that the reservoir 22 could be completely enclosed; in this manner, the gaseous stream emitting from the fluid may be returned directly to the compressor 64 with suitable piping.

Figure 6:
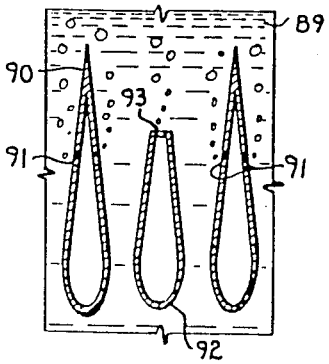
FIG. 6 is an enlarged and fragmentary side elevational view of a first modified set of injector members.

FIG. 6 shows a modified embodiment of airfoils 90 and 92 for use in an expansion chamber 89 similar to the expansion chamber of the previous embodiment. The airfoils 90 and 92 of this embodiment have air dispersing apertures 91 and 93 respectively positioned substantially near or at a downstream end thereof, and the airfoils 90 and 92 are otherwise similar to the airfoils 45 of the previous invention.

Figure 8:
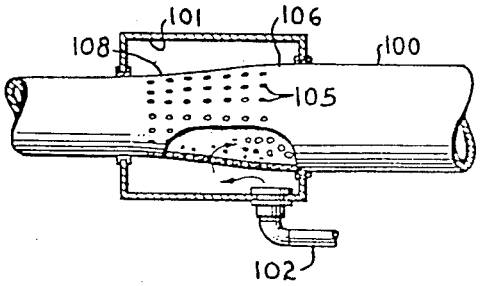
FIG. 8 is a fragmentary side elevational view of a third modified embodiment of a riser leg showing a porous gas injector.

Disclosed in FIG. 8 is a second modified embodiment of the present invention disclosing a portion of a riser leg 100 thereof. In this embodiment, a gaseous substance is injected into the riser leg 100 from a pressurization chamber 101 fed by a compressed gas means 102. The compressed gas passes through a plurality of apertures 105 in the side of the riser leg 100. The apertures are positioned within a region 106 of divergence in the riser leg 100. In this particular embodiment, the compressed gas is injected into a horizontal portion 108 of the riser leg 100 just after the fluid therein has passed through a generator (not shown).

Figure 9:
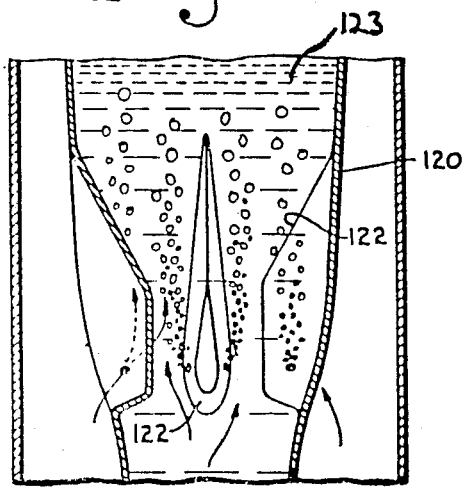
FIG. 9 is a side elevational view of a fourth modified embodiment of the riser leg showing an airfoil fin distribution therein.

FIG. 9 discloses a third embodiment of the present invention, wherein a riser leg 120 is provided with a plurality of gas dispensing airfoil fins 122 projecting from the inside thereof at circumferentially spaced positions. Gas passes through the fins 122 into a fluid 123 within the riser leg 120. The riser leg 120 of the present embodiment is otherwise substantially similar to the riser leg 16 of the first embodiment.

It is noted that certain drawings of the present invention have been exaggerated in scale to more clearly disclose detail thereof.

The utilization of the device disclosed in the present invention allows storage of electrical energy during periods of low consumption for use during later periods of high consumption. Calculations indicate that the present invention may also be able to provide an energy output substantially equal to or in excess of the energy input thereinto through the gas compressor. In particular, the following theoretical example is offered to illustrate this feature which is expected to occur only when the density of the fluid in the riser leg is substantially low (in the nature of 30 percent, and especially below 10 percent, the normal density of the fluid) and is also somewhat dependent on the size and length of the riser leg. The following example is a carefully calculated estimate of the operational characteristics of such a device; however, applicant does not intend to be restricted in the present invention by any of the calculations set out hereinbelow:

EXAMPLE

The hydrodynamic energy storage and production device of the present example is essentially that illustrated in FIG. 2.

Assuming the temperature of air is 520 degrees Rankine, and the value for constant K is 1.4, it is calculated that the output power from a conventional electrical generator produced by a device having a riser leg of 100 feet length and an internal lower downcomer diameter of 8 feet is approximately equal to the power input into the air compressors when the density of the fluid at the point of injection in the riser leg is 30 percent of the density of the fluid in the downcomer leg (both input and output power equal about 15.5 megawatts). Additionally, when the density of the fluid in the riser leg is 10 percent of the density of the fluid in the downcomer leg, the input power to the air compressor is about 12 megawatts and the output power is about 22 megawatts for a net generation of 10 megawatts.

It is to be understood that while certain embodiments of the present invention have been described and shown herein, it is not to be limited to the specific form or arrangement of parts herein described and shown.

What is claimed and desired to be secured by Letters Patent is as follows:

1. A method of producing electrical energy comprising the steps of:

(a) placing a first fluid in a loop having first and second generally vertical legs, said legs connected near lower ends thereof to an electrical generator; said second leg having a lower portion of substantially smaller diameter than an upper portion thereof;

(b) injecting a gaseous fluid into said first fluid in said second leg at a location vertically spaced from the top of said first leg and at a location between said lower portion and said upper portion of said second leg whereat said second leg substantially increases in cross-sectional area; said gaseous fluid having a density substantially less than said first fluid; said injection of said gaseous fluid being generally between the first and second portions of said second leg such that said first fluid expands to a lower density after the injection of said gaseous fluid relative to the density of said fluid before injection of said gaseous fluid thereinto;

(c) whereby at least a portion of said first fluid in said second leg is of a density less than the density of said fluid in said first leg, such that said fluid flows from said first leg to said second leg thereby motivating said generator to produce electricity.

2. The method according to claim 1 including the step of:

(a) adding a foaming agent to said first fluid.

3. A method for producing electrical energy comprising the steps of:

(a) compressing a gas with a gas compressor;

(b) placing a liquid in a loop having first and second generally vertically aligned legs, said legs being interconnected near a lower end thereof; said loop including a hydrodynamic-type generator adapted to generate electricity upon flow of said fluid through said loop;

(c) injecting said compressed gas into said second leg at a location whereat the cross-sectional area of said second leg increases substantially and such that the density of the fluid above the location of gas injection is at most 30 percent of the normal density of the fluid; whereby fluid flows in said loop from said first leg to said second leg motivating said generator to produce electricity;

(d) utilizing a portion of said produced electricity to operate said compressors; and (e) removing excess produced electricity.

4. A method according to claim 3 wherein:

(a) said gas in injected at a location in said second leg wherein said second leg diverges in approximate proportion to the decrease in density of said fluid occasioned by injection of said gas.

5. A method according to claim 3 including the step of:

(a) adding a foaming agent to said fluid before injection of said gas thereinto.

6. A method according to claim 3 wherein:

(a) the density of said fluid after injection of said gas is at most 10 percent of the normal density of said fluid.

* * * * *